United States Patent [19]

Perper

[11] Patent Number: 4,609,852

[45] **Date of Patent: * Sep. 2, 1986**

[54] LAMP BALLAST WITH NEAR UNITY POWER FACTOR AND LOW HARMONIC CONTENT

[75] Inventor: Lloyd J. Perper, Tucson, Ariz.

[73] Assignee: Iota Engineering Co., Tucson, Ariz.

[ * ] Notice: The portion of the term of this patent subsequent to Aug. 27, 2002 has been disclaimed.

[21] Appl. No.: 613,233

[22] Filed: May 24, 1984

Related U.S. Application Data

[63] Continuation-in-part of Ser. No. 522,505, Aug. 12, 1983, Pat. No. 4,538,094.

[51] Int. Cl.[4] ..... H05B 41/16

[52] U.S. Cl. ..... 315/278; 315/276; 315/283

[58] Field of Search ..... 315/278, 276, 283

[56] References Cited

U.S. PATENT DOCUMENTS

| | | | |
|---|---|---|---|
| 2,485,398 | 10/1949 | Mandl | 315/278 |
| 3,781,595 | 12/1973 | Samuels | 315/101 |
| 4,045,711 | 8/1977 | Pitel | 315/278 |
| 4,105,931 | 8/1978 | Pritchard et al. | 315/278 |
| 4,538,094 | 8/1985 | Perper | 315/221 |

*Primary Examiner*—Harold Dixon

*Attorney, Agent, or Firm*—Harris, Kern, Wallen & Tinsley

[57] ABSTRACT

A magnetic ballast circuit for a fluorescent lamp providing improved power factor, reduced harmonic content and increased efficiency. A ballast circuit with three inductances connected at a junction, preferably with the first and second inductances comprising a tapped autotransformer, with the third inductance connected between a line terminal and the tap, with the first inductance connected in series with a capacitance to the other line terminal, and with the second inductance connected to the load. The first inductance may be provided totally as part of the autotransformer, or may be supplemented with a second inductance in series. In an alternative embodiment, separate inductances may be utilized. Alternative lamp filament power sources and alternative functionally equivalent core and winding configurations are disclosed.

21 Claims, 12 Drawing Figures

LAMP BALLAST WITH NEAR UNITY POWER FACTOR AND LOW HARMONIC CONTENT

This application is a continuation-in-part of copending application of the same title, Ser. No. 522,505, filed Aug. 12, 1983, now U.S. Pat. No. 4,538,094.

BACKGROUND OF THE INVENTION

This invention relates to magnetic ballast for fluorescent lamps and in particular, to a new and improved ballast which has near unity power factor with low harmonic content and improved efficiency.

In the past, magnetic ballast circuits have been of three types: inductive, capacitive and resistive. Since a fluorescent lamp tends to have a high impedance and low current before ignition, and the reverse thereafter, it has been conventional to employ an impedance in series with the lamp to provide a high starting voltage and a reduced operating current.

In the pre-heat inductive circuit, the lamp is typically connected in series with an inductor and energized from two opposing filament terminals. The other two terminals are connected to a starter, typically a gas-tube-operated contactor and capacitor in parallel. When a voltage is first applied, the lamp filaments are cool and the starter gas-tube ignites at a lower voltage than the lamp. As the gas-tube warms, its built-in contactors close; filament current flows in the lamp and the inductor is energized. The closing of the contactors removes the voltage from the gas-tube, which cools, opening the contactors, which then cycle on and off. Each time that the contactors open, the energy stored in the series inductor tends to produce a voltage spike across the lamp, whose breakdown voltage with heated filaments is lower than that of the gas-tube. When the lamp ignites, the gas-tube extinguishers and its contact cycle ceases. The parallel capacitor in the starter is used to suppress electromagnetic effects associated with transients generated in the system.

This form of uncorrected magnetic ballast has a low power factor (typically 0.55) since the current passing through the inductor lags the applied voltage. Also it has appreciable ohmic loses in any practical size and cost configuration; by way of example, 3–5 watts in a typical 20 watt lamp ballast.

The inductor operating region is typically such as to be in partial saturation at maximum pre-heat current, and the saturation or swinging choke characteristics are important. Of three inductors, all testing the same inductance and resistance on a meter, one could operate properly as a ballast; the second could fail to light the lamp; and the third could blow out the lamp filaments.

Series capacitive ballasting is closely related to inductive ballasting with the current leading instead of lagging, but with increased higher-frequency current components. It tends to be more efficient in operation with little ohmic loss, but does not have the desirable igniter starting characteristic of an inductive ballast with contactors. A combination of leading and lagging ballasts may be used for lamp pairs, thereby correcting power factor, but not necessarily correcting waveform.

Series resistive ballasting has good power factor and waveform, but poor efficiency, and is not considered a viable alternative.

A power factor corrected ballast using a capacitor across the input line to tune out the series inductive reactance at 60 hertz has been tested. While this configuration corrected the power factor, it raised the third harmonic current from about 8% to 12%.

Another type of power factor correction that is commonly used in rapid-start magnetic ballasts involves the use of a series capacitor to resonate with the inductor at 60 hertz. The current drawn in such a resonant circuit is typically a distorted sine wave, and would not be likely to meet stringent harmonic requirements.

When using the starter to ignite a fluorescent lamp, the lamp filaments are initially energized and are deenergized when the lamp has ignited and the contact cycle of the starter has terminated. This mode of operation is sometimes referred to as "pre-heat" powering. Rapid start and trigger start fluorescent lamps are now available, and the conventional ballast inherently provides power to the filaments without requiring the switching of the starter. The filaments may be powered throughout the lamp operation, with the filament current typically dropping to half its initial value and with the filament resistance also dropping when the lamp ignites, resulting in an order-of-magnitude decrease in filament power. This type of starting arrangement eliminates the conventional starter with its contactor and its inherent problems.

It is an object of the present invention to provide a new and improved magnetic ballast of the series inductive (also known as the core-coil and capacitor type) type which will have a high power factor and a low harmonic content, as well as improved efficiency. One specific circuit of the present invention exhibits a power factor greater than 0.9 with a harmonic content of less than 5%, and power savings in comparison with the conventional single series inductance in the order of 10%.

It is also an object of the present invention to provide such a new and improved ballast which can be utilized with lamp starters for pre-heat powering and alternatively with rapid and trigger start lamps without lamp starters. A further object is to provide various circuits for the filament power source, including circuits which require a minimum of conductors wired between opposite ends of the fluorescent lamp; in one embodiment, only two. It is an additional object of the present invention to provide various core and coil configurations while achieving the desired operating characteristics so that various options of cost, size and weight are available.

Other objects, advantages, features and results will more fully appear in the course of the following description.

SUMMARY OF THE INVENTION

A ballast circuit for a fluorescent lamp for connection between ac line terminals and lamp load terminals, the ballast circuit including first, second and third inductances connected at a junction, with a capacitance connected between the first inductance and one line and load terminal, the second inductance connected to the other load terminal, and the third inductance connected to the other line terminal. In the preferred embodiment, the first and second inductances comprise a tapped autotransformer with the third inductance connected at the tap. In other embodiments, all three inductances may be wound on a single core in various balanced and unbalanced configurations. In situations where space is a problem, an additional separate inductance may be provided in series with the first inductance. In another alternative embodiment, separate inductances may be utilized in place of the autotransformer configuration. Various filament power sources are provided.

DESCRIPTION OF THE PREFERRED EMBODIMENTS

Figure 1:
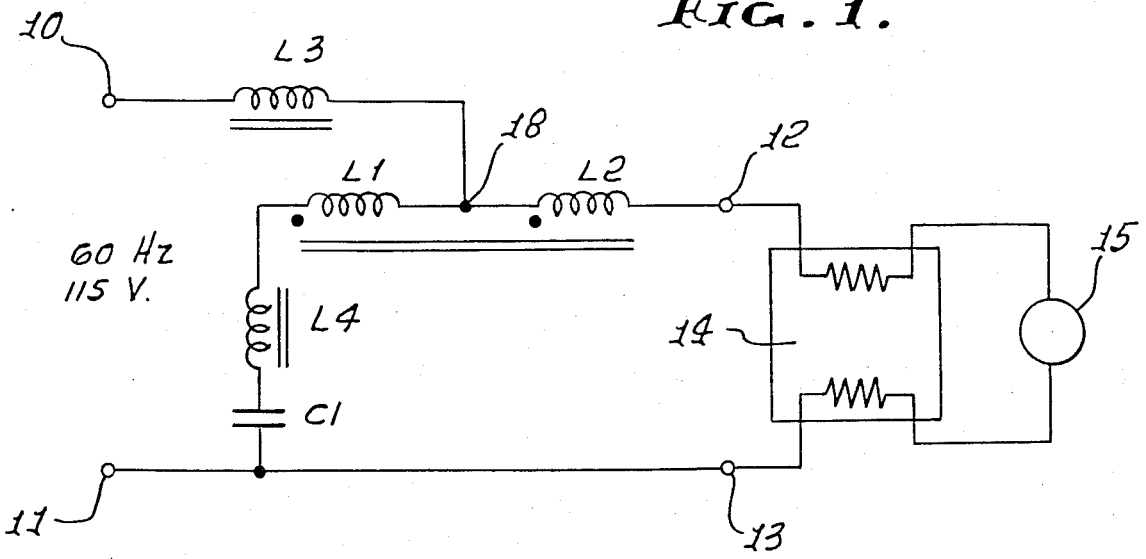
FIG. 1 is an electrical schematic of a magnetic ballast circuit for a fluorescent lamp and incorporating the presently preferred embodiment of the invention.

In the circuit of FIG. 1, a magnetic ballast is connected between line terminals 10, 11 and load terminals 12, 13. A fluorescent lamp 14 with starter 15 is connected across the load terminals 12, 13. A typical supply voltage, such as 115 volts at 60 hertz is connected to the line terminals 10, 11.

Inductances L1, L2 and L3 are connected at a junction 18. In the embodiment illustrated, the inductances L1 and L2 are formed as a tapped winding on an autotransformer, and the inductance L3 is connected between load terminal 10 and the autotransformer tap or junction 18. A capacitance C1 is connected between the inductance L1 and the other line terminal 11. When needed, an additional inductance L4 is connected in series with the inductance L1. The inductance L2 is connected to the load terminal 12, and the line terminal 11 and load terminal 13 are connected together.

In the embodiment illustrated in FIG. 1, the autotransformer configuration is preferred because it permits manufacture of the circuit with lower inductance magnitudes for L1 and L2 where the currents are high, and therefore fewer turns and lower ohmic losses. When winding space on the particular core utilized permits, the inductance L4 may be combined with the inductance L1 by making the inductance L1 sufficiently large.

The circuit of FIG. 1 operates as a low pass filter with a rejected frequency region. At the same time, it has the desired swinging choke characteristics needed for preheat starting of the lamp, which an ordinary low pass filter does not have.

The magnitude of the capacitance C1 and of the inductance L1 (or L1 plus L4) is selected so that the series circuit will resonate at a low multiple of the line frequency, typically the third harmonic. The capacitance C1 may be positioned as shown in FIG. 1 or may be positioned between the inductances L1, L4. The inductances L2 and L3 serve to limit the lamp current to a predetermined value depending upon the particular lamp, its current rating, and the desired output. The inductance L3 serves to prevent oscillation in the circuit and to filter harmonics of the line frequency from the line. While the greater the inductance, the better the filtering action, it is preferred to choose the magnitude of inductance of L3 to be as low as possible consistent with acceptable current waveshape, in order to hold down the iron and wire requirements. The magnitudes of the various components for one specific circuit is set out in Table 1, where M is the mutual inductance of the autotransformer. For this particular circuit operating at 60 hertz, the power factor was greater than 0.9, the harmonic content was less than 5%, and the power saving over a corresponding circuit with a conventional single series inductance was in the order of 10% using a larger wire diameter.

TABLE 1

(FIG. 1)
60 hertz 115 volts

| | | | |
|---|---|---|---|
| L1 | 23.5 mh | M | 83 mh |
| L2 | 294 mh | Cl | 6 microfarads |
| L3 | 112 mh | lamp | F20T12CW |
| L4 | 59 mh | | |

Figure 2:
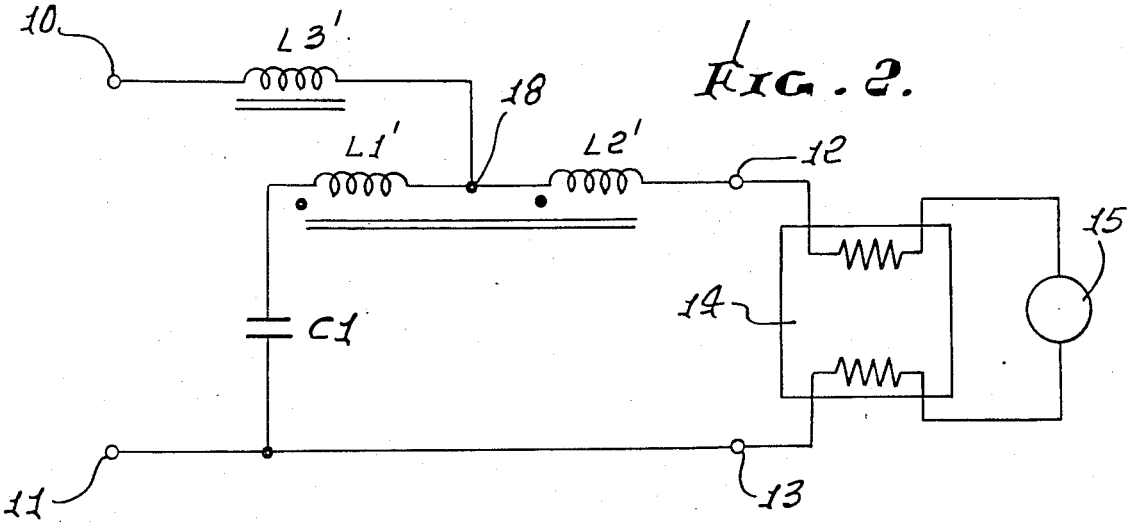
FIG. 2 is an electrical schematic similar to that of FIG. 1 showing an alternative embodiment of the invention.

An alternative configuration for the magnetic ballast is shown in FIG. 2, where elements corresponding to those of FIG. 1 are identified by the same reference numerals with the two embodiments being functional equivalents. In the circuit of FIG. 2, separate inductances L1′ and L2′ are used in place of the autotransformer. The capacitance C1 may be positioned as shown or may be positioned between the inductance L1′ and junction 18. The operation of the circuit is the same as for the circuit of FIG. 1, and values for components are set out in Table 2. While this configuration is easier to analyze, the magnitudes of inductance required are greater and hence the resultant circuit is larger and more expensive than that of FIG. 1.

TABLE 2

(FIG. 2)
60 hertz 115 volts

| | | | |
|---|---|---|---|
| L1′ | 166 mh | Cl | 6 microfarads |
| L2′ | 376 mh | lamp | F20T12CW |
| L3′ | 29 mh | | |

Figure 3:
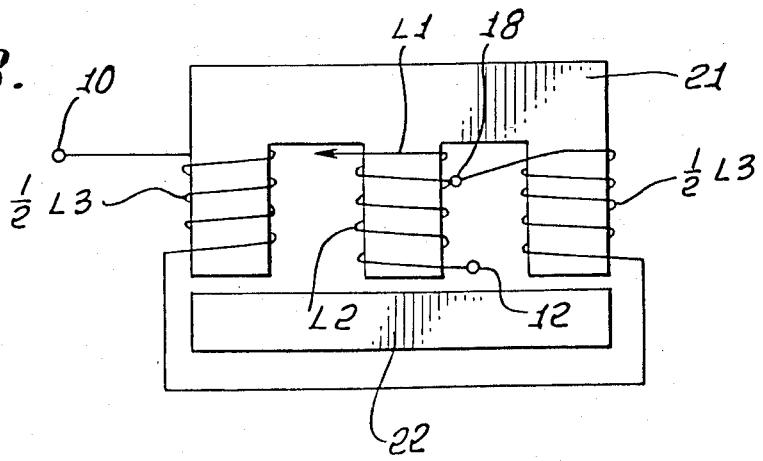
FIG. 3 illustrates a core and coil configuration suitable for use in the circuit of the invention.

FIG. 3 illustrates the winding of all three inductances on a single core using a conventional core arrangement with an E stack 21 and an I stack 22. The inductances L1 and L2 are wound on the center leg, and one half of inductance L3 is wound on each of the outer legs. With this arrangement, the magnitude of the inductance L3 is independent of the center leg except for interactions due to nonlinearity. With this configuration, the major air gap would be at the center leg, and depending upon the specific design, only a small gap or no gap at all would be needed at the outer legs.

Figure 4:
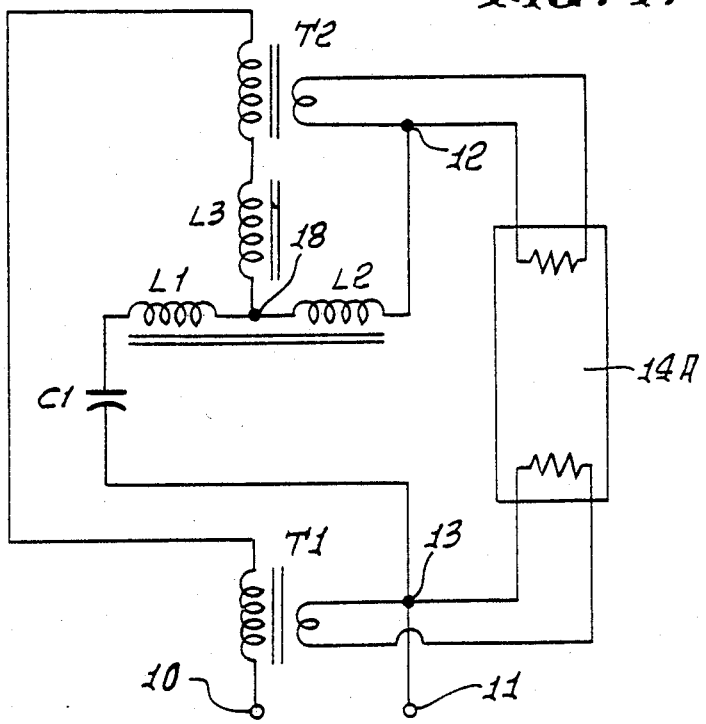
FIG. 4 is an electrical schematic similar to that of FIG. 1 showing another alternative embodiment of the invention incorporating current transformers for filament powering.

In the embodiment of FIG. 4, a rapid start or trigger start lamp 14A is utilized, and the starter 15 is omitted. Current transformers T1 and T2 provide the power for the lamp filaments. The primary windings of the transformers T1 and T2 are connected in series between the line terminal 10 and the inductance L3, with the secondary windings of the transformers connected to the respective filaments of the lamp. The basic operation of the circuit of FIG. 4 is the same as that of the circuit of FIG. 1, with corresponding components identified by the same reference numbers. The current drawn by the circuit is high when the fluorescent lamp is not ignited, and therefore a relatively high filament current is provided. The line current reduces to a low value when the lamp is lighted, thereby providing high filament heat during start and reduced power consumption during normal operation.

In addition to omitting the starter 15 and its contactor problems, the circuit of FIG. 4 requires only two wires extending along the lamp, rather than three as required by the circuits of FIGS. 1 and 2. This can be of special value when installing the ballast of the present invention in an existing lighting arrangement which has only two wires in place. These advantages are achieved at the expense of the requirement of two small current transformers.

Figure 5:
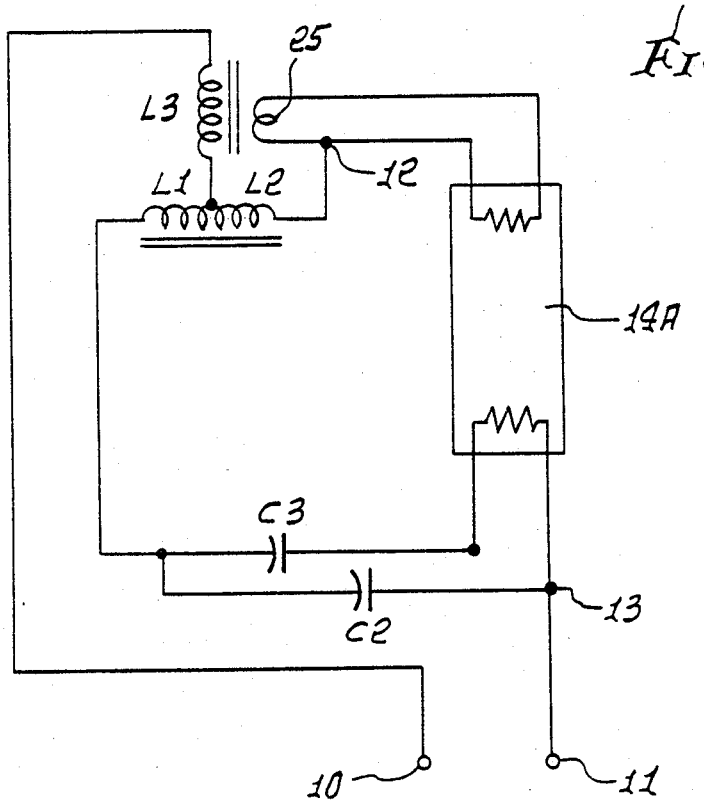
FIG. 5 is an electrical schematic similar to that of FIG. 4 showing an alternative embodiment of filament powering.

An alternative embodiment to the circuit of FIG. 4 is shown in FIG. 5, where the separate current transformers T1, T2 are not required. The capacitance C1 is split into two capacitances C2, C3, with C2 connected between line terminal 11 and inductance L1, and with C3 connected between inductance L1 and a lamp filament. This filament is powered by the ballast current, capacitively divided. An additional winding 25 on the core of the series inductance L3 provides the power for the other filament of the lamp.

Figure 6:
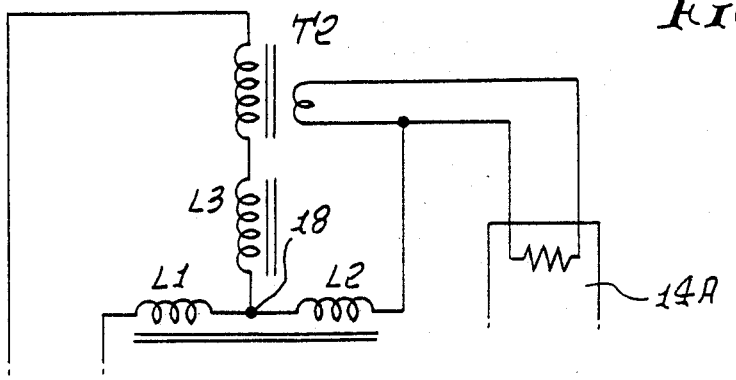
FIGS. 6 and 7 are partial electrical schematics similar to that of FIG. 5 showing additional embodiments for filament powering.

FIG. 6 shows a variation for the circuit of FIG. 5, utilizing the current transformer T2 for one filament rather than the additional winding 25, in the same manner as in FIG. 4, while having the split capacitances C2, C3 for powering the other filament.

Figure 7:
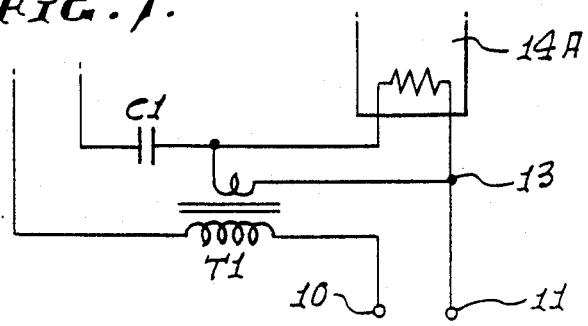

FIG. 7 shows another variation of the circuit of FIG. 5, with the current transformer T1, as in the circuit of FIG. 4, for powering one filament, with the other filament powered from the winding 25.

Figure 8:
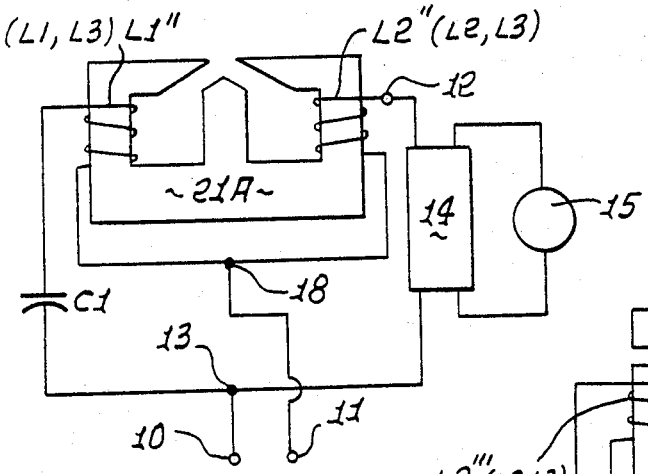
FIG. 8 illustrates an alternative embodiment of core and coil configuration.
Figure 9:
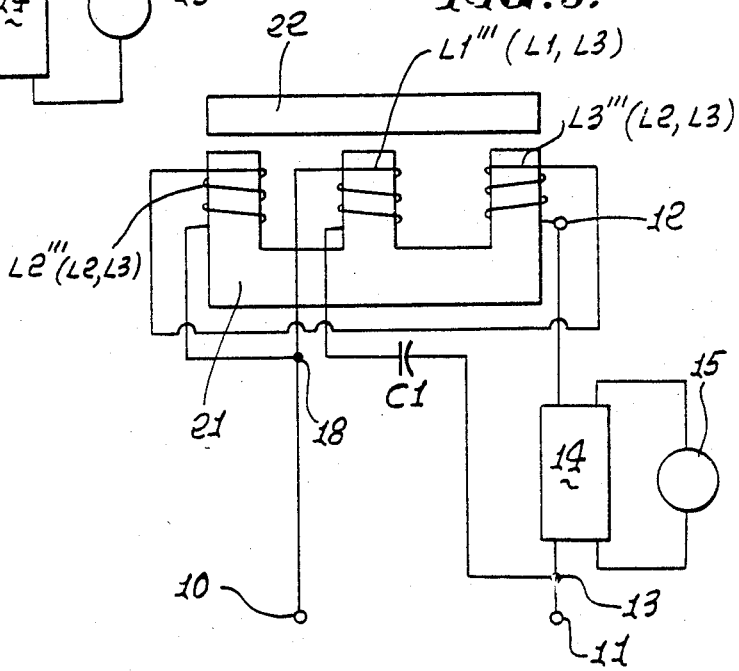
FIG. 9 illustrates another alternative embodiment of core and coil configuration.

Alternative functionally equivalent arrangements for placing the three inductances on a single core are shown in FIGS. 8 and 9. The configuration of FIG. 8 is a two coil, consolidated core ballast. An inductance L1″ (corresponding to L1 and a portion of L3) is wound on one outer leg of the E core 21A, and an inductance L2″ (corresponding to L2 and a portion of L3) is wound on the other outer leg. No I stack 22 is utilized. The gaps at the center leg of the E core are selected so as to provide high self inductances but a small mutual inductance between the two coils. The mutual inductance is subtractive so that a series inductive reactance equal to the mutual inductance is produced in the equivalent circuit. Neither coil is tapped. See Table 3 for values for one circuit.

TABLE 3

| (FIG. 8) | | | |
|---|---|---|---|
| L1″ | 195 mh | Cl | 6 microfarads |
| L2″ | 406 mh | lamp | F20T12CW |
| M | −29 mh | | |

The configuration of FIG. 9 is an unbalanced three-coil, consolidated ballast. An E stack 21 and an I stack 22 are used, with coils on all three legs. An inductance L1‴ (corresponding to L1 and a portion of L3) is provided by the coil on the center leg. An inductance L2‴ (corresponding to a portion of L2 and L3) is provided on one outer leg, and an inductance L3‴ (corresponding to a different portion of L2 and L3) is provided on the other outer leg. The windings on the two outer legs of the core are unequal such that the mutual impedance between L1‴ and L2‴, L3‴ is differentially small. In this configuration, the equivalent of the two loosely coupled coils of the configuration of FIG. 8 is produced as a result of partial flux cancellation rather than by the gap configuration. None of the three coils is tapped.

Figure 10:
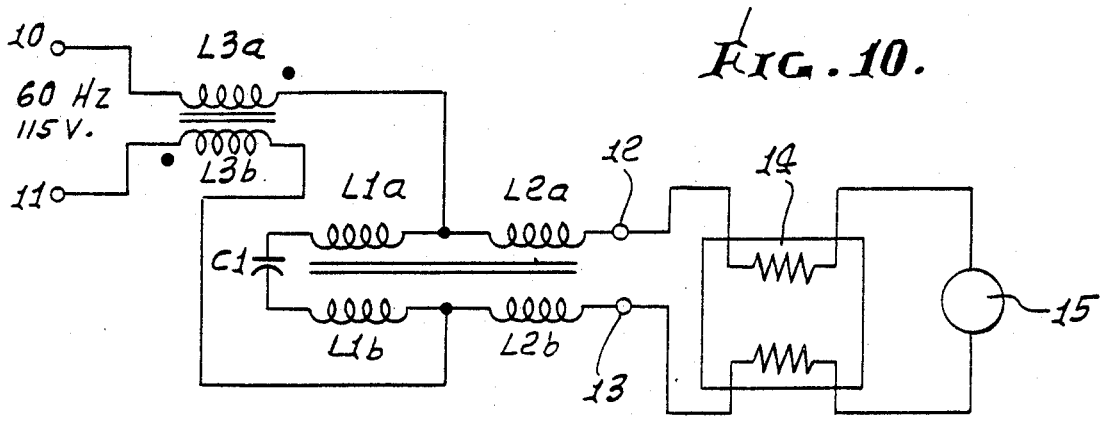
FIGS. 10–12 illustrate balanced configurations of the circuits of FIGS. 1 and 2.
Figure 11:
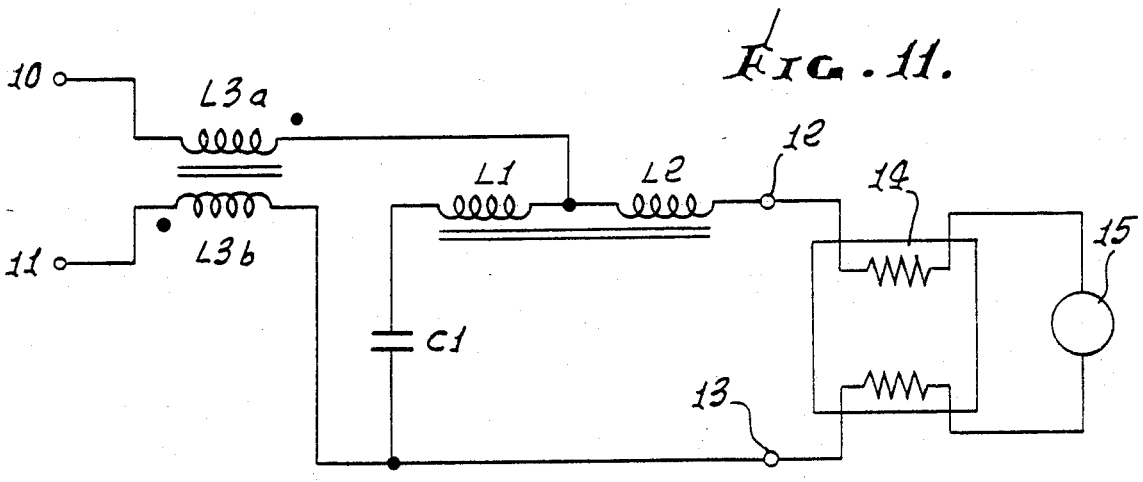
Figure 12:
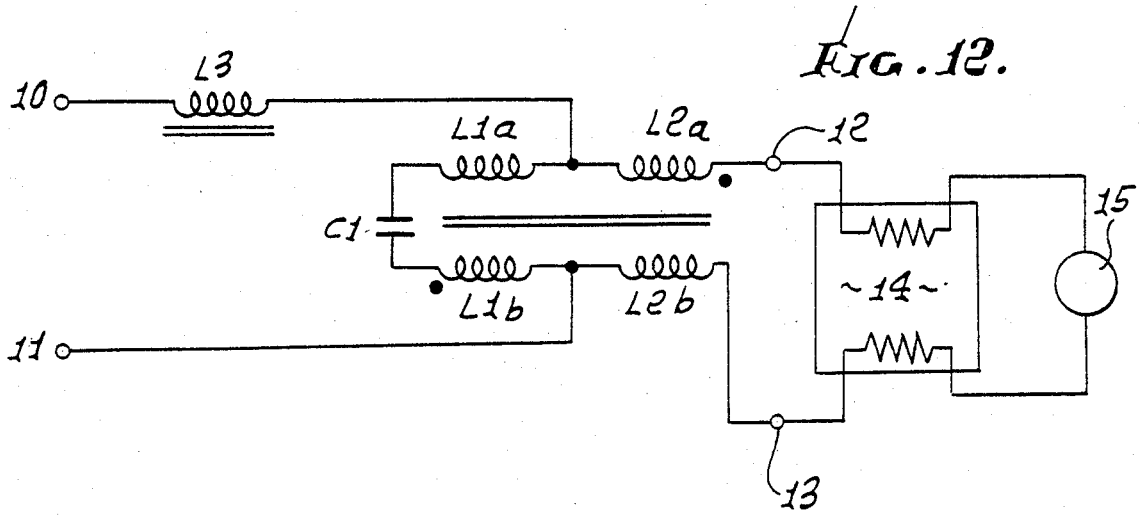

The circuitry shown in FIGS. 1–9 is of the "unbalanced-to-common" form. The present invention is equally applicable to balanced configurations and two examples are shown in FIGS. 10–12, which are the equivalent of the examples of FIGS. 1 and 2. Similar balanced configurations can be produced for the circuits of FIGS. 4–9.

In the circuit of FIG. 10, the inductances L1, L2 and L3 are each divided into two equal windings L1a and L1b, L2a and L2b, and L3a and L3b, and the halves are proportioned symmetrically, so that the same total inductances exist on a balanced basis. The balanced type of circuitry serves to reduce the interference transmittal on a balanced line by a source that acts similarly on both lines (common-mode interference).

In the circuit of FIG. 11, only one of the inductances is balanced, namely L3, which is replaced by L3a and L3b. In the circuit of FIG. 12 only inductances L1 and L2 are balanced as L1a and L1b, and L2a and L2b, with a single inductance L3.

I claim:

1. A ballast circuit for a fluorescent lamp, comprising in combination:

means defining first and second line terminals;

means defining first and second load terminals, with said second line terminal connected to said second load terminal;

first, second and third inductances connected at a junction;

a capacitance connected in series with said first inductance between said junction and said second line terminal, with said second inductance connected to said first load terminal and said third inductance connected to said first line terminal; and first and second fluorescent lamp filament power sources for providing electric power to the respective lamp filaments;

with the magnitudes of said capacitance and the inductance in series with it selected to provide series resonance to produce about a minimum third harmonic line current with a connected load.

2. A ballast circuit as defined in claim 1 wherein said first and second inductances comprise an autotransformer, with said third inductance connected at a tap on said autotransformer.

3. A ballast circuit as defined in claim 2 including a fourth inductance separate from said autotransformer and connected in series with said first inductance and said capacitance.

4. A ballast circuit as defined in claim 2 wherein said first, second and third inductances are wound on a single core, with said first and second inductances having a tapped winding on one leg of said core and said third inductance having a winding on at least one other leg of said core.

5. A ballast circuit as defined in claim 4 wherein said core has three parallel legs, with said tapped winding of said first and second inductances on the center leg thereof and with said winding of said third inductance formed in two sections on the outer legs thereof.

6. The ballast circuit as defined in claim 1 wherein said first, second and third inductances are separate windings on three separate cores.

7. A ballast circuit as defined in claim 1 wherein the inductance of said second inductance is selected to limit the current to a lamp connected at said load terminals to a predetermined amount.

8. A ballast circuit as defined in claim 7 wherein the inductance of said third inductance is selected to filter harmonics of the line frequency between said load terminals and said line terminals.

9. A ballast circuit as defined in claim 1 wherein at least one of said filament power sources comprises a transformer with a primary winding connected between one of said line terminals and one of said inductances, and a secondary winding for connecting to a lamp filament.

10. A ballast circuit as defined in claim 1 wherein one of said filament power supplies comprises a transformer with said third inductance as the primary winding, and having a secondary winding for connecting to a lamp filament.

11. A ballast circuit as defined in claim 1 with said capacitance split into first and second capacitance sections, with said first capacitance section connected between said second load terminal and said first inductance, and with said second capacitance section between said first inductance and a filament terminal, to form one of said filament power sources.

12. A ballast circuit as defined in claim 1 wherein one of said filament power sources comprises a transformer with said third inductance as the primary winding and having a secondary winding for connecting to a lamp filament, and with said capacitance split into first and second capacitance sections, with said first capacitance section connected said second load terminal and said first inductance and with said second capacitance section connected between said first inductance and a filament terminal, to form the other of said filament power sources.

13. A ballast circuit for a fluorescent lamp, comprising in combination:

means defining first and second line terminals for connection to an electrical power source;

means defining first and second load terminals for connection to an electrical load, with said second line terminal connected to said second load terminal;

a magnetic core having three parallel legs;

first and second coils connected at a junction, with said first coil on one of said outer legs and said second coil on the other of said outer legs; and a capacitance connected in series with said first coil between said junction and said second line terminal, with said second coil connected to said first load terminal;

with the air gap at the ends of said three core legs providing a magnetic coupling coefficient between said coils of a polarity to reduce the inductance of the equivalent circuit of the ballast circuit.

14. A ballast circuit for a fluorescent lamp, comprising in combination:

means defining first and second line terminals;

means defining first and second load terminals, with said second line terminal connected to said second load terminal;

a magnetic core having three parallel legs;

first, second and third coils connected at a junction, with said first coil on the center leg of said core and with said second and third coils on the outer legs of said core, respectively, and with said first and second coils connected at a junction and with said second and third coils connected in series; and a capacitance connected in series with said first coil between said junction and said second line terminal, with said second coil connected to said first line terminal and said third coil connected to said first line terminal.

15. A ballast circuit as defined in claim 14 wherein said second and third coils are of unequal inductance providing a subtractive mutual inductance with respect to said first coil.

16. A ballast circuit for a fluorescent lamp, comprising in combination:

means defining first and second line terminals;

means defining first and second load terminals, with said second line terminal connected to said second load terminal;

first, second and third inductances connected at a junction; and a capacitance connected in series with said first inductance between said junction and said second line terminal, with said second inductance connected to said first load terminal and said third inductance connected to said first line terminal;

with the magnitudes of said capacitance and the inductance in series with it selected to provide series resonance to produce about a minimum third harmonic line current with a connected load; and with said inductances formed in two coils wound on a core having three parallel legs, with one of said coils providing said first inductance and a portion of said third inductance wound on one outer leg and with said the other of said coils providing said second inductance and a portion of said third inductance wound on the other outer leg, and with the air gap at the ends of said three core legs providing a magnetic coupling coefficient between said coils that is of a polarity to reduce the inductance of the equivalent circuit of the ballast circuit.

17. A ballast circuit for a fluorescent lamp, comprising in combination:

means defining first and second line terminals;

means defining first and second load terminals, with said second line terminal connected to said second load terminal;

first, second and third inductances connected at a junction; and a capacitance connected in series with said first inductance between said junction and said second line terminal, with said second inductance connected to said first load terminal and said third inductance connected to said first line terminal;

with the magnitudes of said capacitance and the inductance in series with it selected to provide series resonance to produce about a minimum third harmonic line current with a connected load; and with said inductances formed in first, second and third coils wound on a core having three legs, with said first coil providing said first inductance and a portion of said third inductance wound on the center leg, and with said second coil providing a portion of each of said second and third inductances wound on one outer leg, and with said third coil providing a portion of each of said second and third inductances wound on the other outer leg, with said second and third coils of unequal inductance providing a subtractive mutual inductance with respect to said first coil.

18. A ballast circuit for a fluorescent lamp, comprising in combination:

means defining first and second line terminals;

means defining first and second load terminals, with said second line terminal connected to said second load terminal;

first, second and third inductances connected at a junction; and a capacitance connected in series with said first inductance between said junction and said second line terminal, with said second inductance connected to said first load terminal and said third inductance connected to said first line terminal;

with the magnitudes of said capacitance and the inductance in series with it selected to provide series resonance to produce about a minimum third harmonic line current with a connected load; and with said circuit being a balanced-to-common circuit with common-mode-rejection.

19. A ballast circuit for a fluorescent lamp, comprising in combination:

means defining first and second line terminals;

means defining first and second load terminals, with said second line terminal connected to said second load terminal;

first, second and third inductances connected at a junction; and a capacitance connected in series with said first inductance between said junction and said second line terminal, with said second inductance connected to said first load terminal and said third inductance connected to said first line terminal;

with the magnitudes of said capacitance and the inductance in series with it selected to provide series resonance to produce about a minimum third harmonic line current with a connected load; and with said third inductance divided symmetrically between said first and second line terminals.

20. A ballast circuit as defined in claim 19 wherein each of said first and second inductances is divided symmetrically between said first and second load terminals, with said capacitance connected between the divided portions of said first inductance.

21. A ballast circuit for a fluorescent lamp, comprising in combination:

means defining first and second line terminals;

means defining first and second load terminals, with said second line terminal connected to said second load terminal;

first, second and third inductances connected at a junction; and a capacitance connected in series with said first inductance between said junction and said second line terminal, with said second inductance connected to said first load terminal and said third inductance connected to said first line terminal;

with the magnitudes of said capacitance and the inductance in series with it selected to provide series resonance to produce about a minimum third harmonic line current with a connected load; and with each of said first and second inductances divided symmetrically between said first and second load terminals, with said capacitance connected between the divided portions of said first inductance.

* * * * *